United States Patent [19]

Jacobs et al.

[11] 4,314,175

[45] Feb. 2, 1982

[54] METHOD VAPOR DISCHARGE LAMP HAVING SPECIFIC RANGE OF XENON PRESSURES

[75] Inventors: Cornelis A. J. Jacobs; Johannes A. T. Schellen; Gijsbert Kuus, all of Eindhoven, Netherlands

[73] Assignee: U.S. Philips Corporation, New York, N.Y.

[21] Appl. No.: 132,945

[22] Filed: Mar. 24, 1980

[30] Foreign Application Priority Data

Apr. 26, 1979 [NL] Netherlands ..... 7903285

[51] Int. Cl.[3] ..... H01J 61/26

[52] U.S. Cl. ..... 313/174; 313/185; 313/198; 313/225

[58] Field of Search ..... 313/174, 178, 183, 185, 313/198, 225, 228

[56] References Cited

U.S. PATENT DOCUMENTS 4,146,813 3/1979 van Vliet ..... 313/225 X 4,253,037 2/1981 Driessen et al. ..... 313/225 X

*Primary Examiner*—Paul L. Gensler

*Attorney, Agent, or Firm*—Robert S. Smith

[57] ABSTRACT

The invention relates to a high-pressure sodium vapor discharge lamp which has a discharge vessel in which xenon and a xenon-absorbing substance are present. The xenon is absorbed partly in the absorbing substance. When the temperature is raised xenon is released.

According to the invention, the xenon pressure P at room temperature has a value which satisfies 1 kPa$\leqq$P$\leqq$25 kPa. Herewith it is achieved that a lamp is obtained having good ignition properties and a high xenon pressure in the operating condition of the lamp, resulting in a large luminous flux.

6 Claims, 2 Drawing Figures

METAL VAPOR DISCHARGE LAMP HAVING SPECIFIC RANGE OF XENON PRESSURES

Figure 1:
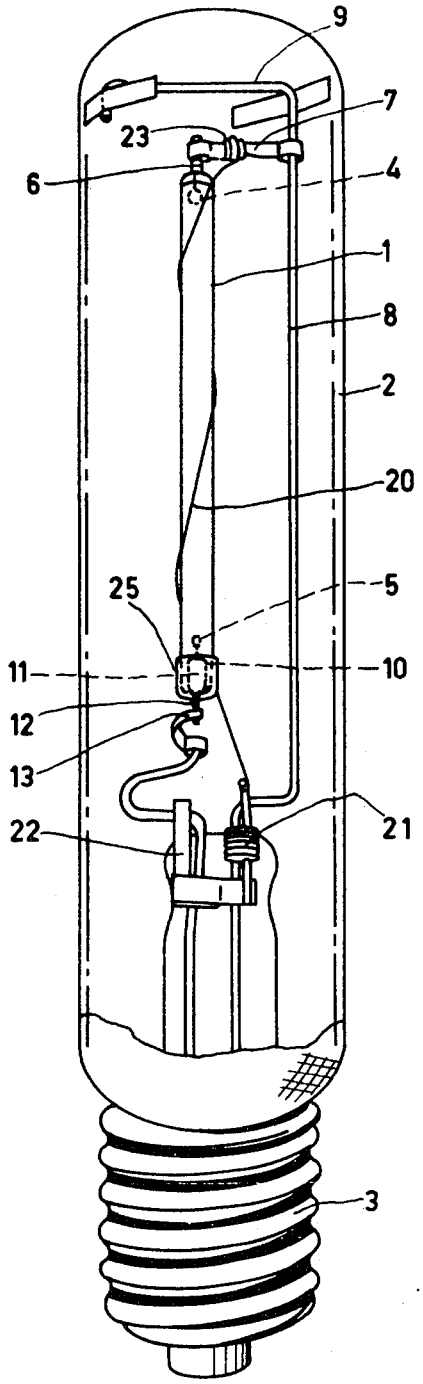

The invention relates to a discharge lamp comprising a discharge vessel in which a metal vapor and xenon are present and an absorbing substance in contact with the xenon in such a manner that the xenon is absorbed at least partly in the absorbing substance and when the temperature is raised is released partly from said substance and at 300K the xenon pressure P is smaller than 100 kPa (kPascal) and in the operating condition of the lamp P is larger than 100 kPa. Such a lamp is known from British Patent Specification No. 669,033. At the above-indicated xenon pressures in the operating condition exceeding 100 kPa, a comparatively large luminous flux of the light source can often be realised. A disadvantage of said known lamp is that the dosing of the absorbing substance leaves much to be desired. The quantity of absorbing substance in one example is so large that so much xenon is absorbed at 300K that a separate starting gas is necessary to start the lamp. This is a disadvantage. It is the object of the invention to provide a solution with which this disadvantage is at least mitigated.

According to the invention, a lamp as mentioned in the opening paragraph, is characterized in that the absorbing substance and the xenon are dosed in such manner that, at 300K, P has a value in the range 1 to 25 kPa.

The advantage of a lamp according to the invention is that at 300K the xenon operates readily as a starting gas and in the operating condition of the lamp a sufficiently high xenon pressure and hence a sufficiently large luminous flux can be obtained.

Experiments have demonstrated that when P at 300K is in the said range, the required ignition voltage is still acceptable. The procedure for designing a discharge lamp according to the invention could be, for example, as follows. It is first established what P in the operating condition of the lamp is desired. From this it is then determined with which P this would correspond at 300K for the case in which no absorbing substance would be present. It is then determined by how much the last-mentioned P must be reduced to be in the said range if 1 kPa and 25 kPa. Just so much absorbing substance is then added to the discharge vessel to achieve this reduction.

The invention is based on the idea of providing the absorbing substance in such a small quantity in the discharge vessel that at 300K a xenon pressure suitable for ignition is present.

In a lamp according to the invention the combination of lamp volume and absorbing substance preferably satisfies:

$$MW/V > 0.1 \text{ kg/cm}^3$$

wherein M is the mass of the absorbing substance in kg; W is the absorption coefficient at 300K for xenon of the absorbing substance in kg of xenon per kg of absorbing substance; and V is the volume in $m^3$ of the interior of the discharge vessel.

A lamp according to this preferred embodiment has for its advantage that a considerable rise of the xenon pressure occurs for a small rise of the temperature and that in the operating condition of the lamp the xenon pressure can be considerably larger than would follow from the xenon pressure at 300K according to Gay Lussac's Law of fixed volumes.

In an improvement of this preferred embodiment of a lamp according to the invention, W at 300K has a value of at least 0.05. An advantage of this improvement is that only a small amount of the absorbing substance is necessary, with the result that only a reduced space is necessary to store the absorbing substance in the lamp.

The absorbing substance may consist of one or more substances, such as fine granular oxides, carbides, borides and metals.

In a further embodiment of a lamp in accordance with the invention the absorbing substance mainly consists of porous carbon of which 10 to 30% by weight is present as graphite and the density of the porous carbon is less than 80% of that absorbing substance in the crystalline state. Here the graphite serves as a binder.

Such a lamp comprises a substance having good absorbing properties so that only a small volume of the absorbing substance is necessary, which is advantageous.

A lamp in accordance with the invention may, for example, be a low-pressure discharge lamp or a high-pressure mercury vapor discharge lamp. In a further advantageous embodiment of a lamp in accordance with the invention the lamp is a high-pressure sodium vapor discharge lamp. An advantage of such a lamp is that it combines compact dimensions with a large luminous flux and good ignition properties.

For explanation the following may be explained. A high-pressure sodium vapor discharge lamp with a discharge vessel in which, in addition to sodium, xenon is also present at a comparatively high pressure in the operating condition of the lamp, is a light source known per se which has a large light output. See, for example, Netherlands Patent Application No. 7704131. The indicated preferred embodiment of a lamp in accordance with the invention in which said lamp is a high-pressure sodium vapor discharge lamp, is advantageous because the required ignition voltage can be smaller than in the known lamp, with the result that, even in the case of a considerable drop in the supply voltage, the lamp can still be made operative.

In an improvement of the last-mentioned embodiment of a lamp in accordance with the invention, the xenon pressure at 300K is approximately 16 kPa and MW/V is approximately 2 $kg/cm^3$. The advantage of this improvement is that a compact lamp having a very large luminous flux and good ignition properties is obtained.

The invention will now be described with reference to a drawing. In the drawing, FIG. 1 is a side elevation, partly broken away, of a lamp according to the invention, and FIG. 2 is a cross-sectional view of a detail of a lead-through construction of the discharge vessel of the lamp shown in FIG. 1.

Figure 2:
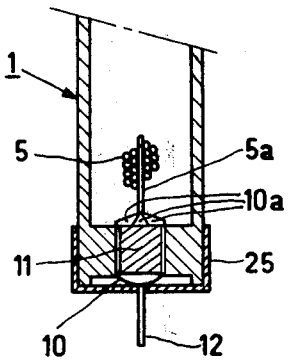

The lamp shown in FIG. 1 is a high-pressure sodium vapour discharge lamp. Reference numeral 1 in FIG. 1 denotes a discharge vessel the wall of which consists of densely sintered aluminium oxide which is enclosed by an outer envelope 2 which has a lamp cap 3. The discharge vessel 1 has two internal main electrodes 4 and 5 between which the discharge is maintained during operation of the lamp. Main electrode 4 is connected to a metal strip 7 via a lead-through 6. This strip 7 is connected to a pole wire 8 which is connected to a contact of the cap 3 of the lamp. An extended part 9 of the pole wire 8 serves to support and center the discharge vessel 1 in the outer envelope 2. The main electrode 5 is connected to a strip-shaped conductor 13 by means of a leadthrough consisting of a tubular cup 10 and a rod 12. The other end of said conductor 13 is connected to another contact in the cap 3 of the lamp. The cup 10 is filled with carbon 11. Near its end where the tubular cup 10 is present the discharge vessel 1 is surrounded by a heat shield 25 extending over the length of the sleeve. The heat shield preferably consists of tantalum.

The discharge vessel has an external auxiliary electrode 20. Near the main electrode 4 said auxiliary electrode 20 is connected by a capacitor 23 to the strip 7. At the other end of the discharge vessel the auxiliary electrode 20 is connected to an auxiliary member 21 in the form of a tension spring. The other end of the auxiliary member 21 is connected to the metal strip 13 with a conductive strip 22.

Reference numeral 1 in FIG. 2 again denotes the discharge vessel of which the part near the main electrode 5 is shown. The cup 10, which together with rod 12 forms the leadthrough to the electrode 5, consists of niobium. Before being provided in the discharge vessel the cup 10 is subjected successively to the following operations. The absorbing substance 11 is first placed in the cup. Then a number of sawcuts (not shown) are provided in the cup at its open side extending in the longitudinal direction of the axis of the cup and the lengths of the sawcuts are substantially half the cup diameter. The niobium strips 10*a* thus formed are then folded inwards and connected together at their free ends to form a connection point. The main electrode 5 is connected to this connection point by means of electrode rod 5*a*. Herewith it is achieved that the carbon can be reached by the xenon. It is also possible for the niobium cup to be covered by a layer of a porous metal.

In another embodiment of a lamp in accordance with the invention the carbon may be provided around the electrode rod 5*a* whether or not contained in a separate sleeve, or an outer electrode winding may be wound around it.

The lamp shown in FIGS. 1 and 2 has a discharge vessel the wall of which consists of densely sintered aluminium oxide. The length of the discharge vessel is approximately 110 mm and the inside diameter is approximately 7.5 mm. The distance between the two internal main electrodes of the discharge vessel is 82 mm, while the distance from a main electrode to the nearest end of the discharge vessel is approximately 11 mm.

The lamp described relates to a high-pressure sodium vapor discharge lamp which is suitable for connection to a supply source of 220 V, 50 Hz via a stabilization ballast (not shown) of approximately 0.11H. In addition to the stabilization ballast, a starter (not shown) is incorporated in the connection to the supply source, which starter may for example, be of the type described in Netherlands Patent Application No. 6904456. The power consumed by the lamp is 400 W. The luminous flux is approximately 135 lm/W. The ignition voltage presented to the discharge vessel is approximately 3 kV.

The filling of the discharge vessel consists of 25 mg of amalgam containing 27% by weight of sodium and 73% by weight of mercury, and xenon. At 300K the xenon pressure is approximately 16 kPa. In the operating condition of the lamp at which the average temperature is approximately 2200K, the xenon pressure is approximately 213 kPa. If no absorbing substance had been present, the xenon pressure in the operating condition of the lamp would have been only approximately 120 kPa.

In the niobium cup, the volume of which is approximately 64 $mm^3$, approximately 45 mg of absorbing substance is present. The absorbing substance consists of porous carbon which, if desired, may be mixed with approximately 22% by weight of graphite and has been compressed in the niobium cup as a pellet under a pressure of approximately $8.10^4$ kPa. The pellet of absorbing substance thus manufactured has a value for W of 0.24 and for MW/V of approximately 2 $kg/cm^3$ at 300K.

For explanation, column 1 of the Table states data of the lamp described and beside it for comparison in column 2 and column 3 data of two lamps not according to the invention. The data in column 2 relate to a high-pressure sodium vapor discharge lamp having xenon as a buffer gas, but without carbon, while the data recorded in column 3 relate to a high-pressure sodium vapor discharge lamp having xenon as a starting gas and without carbon.

TABLE

| | Lamp according to the invention | Lamps not according to the invention | |
|---|---|---|---|
| | | xenon as a buffer gas | xenon as a starting gas |
| supply source (V, Hz) | 220,50 | 220,50 | 220,50 |
| consumed power (W) | 400 | 400 | 400 |
| luminous flux (lm/W) | 135 | 134 | 122 |
| xenon pressure at 300 K (kPa) | 16 | 26.7 | 16 |
| xenon pressure in the operating condition (kPa) | 213 | 213 | 128 |
| required ignition voltage (kV) | 2 | 4 | 2 |

It appears from the data given in the Table that the lamp according to the invention has the same required ignition voltage as a lamp in which the xenon only serves as a starting gas. However, the lamp according to the invention has a luminous flux which corresponds approximately to a lamp in which the xenon serves as a buffer gas. This means that the lamp according to the invention in the operating condition has a large luminous flux while this lamp has a low required ignition voltage.

The lamp described combines a reliable ignition as a result of a xenon pressure at 300K of approximately 16 kPa with an operating condition at a comparatively high xenon pressure of well over 200 kPa and as a result of this also with a large luminous flux of 135 lm/W.

What is claimed is:

1. A discharge lamp comprising a discharge vessel in which a metal vapor and xenon are present and an absorbing substance in contact with the xenon in such a manner that the xenon is absorbed at least partly in the absorbing substance and when the temperature is raised is released partly from said substance and at 300K the xenon pressure P is smaller than 100 kPa and in the operating condition of the lamp P is larger than 100 kPa, characterized in that the absorbing substance and the xenon are dosed so that, at 300K, P has a value in the range 1 kPa to 25 kPa.

2. A discharge lamp as claimed in claim 1, characterized in that the combination of lamp volume and absorbing substance satisfies:

$$MW/V > 0.1\ kg/m^3$$

wherein

M is the mass of the absorbing substance in kg;

W is the absorption coefficient at 300K for xenon of the absorbing substance in kg of xenon per kg of absorbing substance; and V is the volume in $m^3$ of the interior of the discharge vessel.

3. A discharge lamp as claimed in claim 2, characterized in that, at 300K, W is at least 0.05.

4. A discharge lamp as claimed in claim 1, 2 or 3, characterized in that the absorbing substance mainly consists of porous carbon of which 10 to 30% by weight is present as graphite and that the density of the porous carbon is less than 80% of that absorbing substance in the crystalline state.

5. A discharge lamp as claimed in claim 1, 2 or 3, characterized in that it is a high-pressure sodium vapour discharge lamp.

6. A discharge lamp as claimed in claim 5, characterized in that at 300K the xenon pressure is approximately 16 kPa and MW/V is approximately 2 $kg/m^3$.

* * * * *